US006039503A

United States Patent [19]

Cathey

[11] Patent Number: 6,039,503

[45] **Date of Patent: *Mar. 21, 2000**

[54] EXPANSION JOINT SYSTEM

[75] Inventor: Joe Ray Cathey, Claremore, Okla.

[73] Assignee: Silicone Specialties, Inc., Tulsa, Okla.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/015,741

[22] Filed: Jan. 29, 1998

[51] Int. Cl.[7] ..... E01C 11/02; E01C 11/06; E01D 19/06

[52] U.S. Cl. ..... 404/67; 404/47; 404/69; 404/74; 14/73.1

[58] Field of Search ..... 14/73.1; 404/47, 404/48, 64, 67, 68, 69, 72, 74, 17, 18, 28, 29, 31

[56] References Cited

U.S. PATENT DOCUMENTS

| | | | |
|---|---|---|---|
| 1,541,830 | 6/1925 | Larranaga | 404/29 |
| 2,221,431 | 11/1940 | Omansky | 404/47 |
| 2,270,459 | 1/1942 | McConnaughay | 404/18 |
| 3,521,528 | 7/1970 | Wangerow | 404/69 |
| 3,538,820 | 11/1970 | Tonjes | 94/22 |
| 3,702,093 | 11/1972 | Van de Loock et al. | 94/8 |
| 4,068,968 | 1/1978 | Gagle et al. | 404/7 |
| 4,080,086 | 3/1978 | Watson | 404/69 |
| 4,166,049 | 8/1979 | Huff | 260/2.3 |
| 4,279,533 | 7/1981 | Peterson et al. | 404/68 |
| 4,285,612 | 8/1981 | Betti | 404/68 |
| 4,332,504 | 6/1982 | Arai | 404/68 |
| 4,403,067 | 9/1983 | Uffner | 525/54.5 |
| 4,447,172 | 5/1984 | Galbreath | 404/68 |
| 4,470,719 | 9/1984 | Dziark et al. | 404/75 |
| 4,493,584 | 1/1985 | Guntert | 404/74 |
| 4,516,876 | 5/1985 | Wicks | 404/60 |
| 4,518,741 | 5/1985 | Uffner et al. | 525/54.5 |
| 4,522,531 | 6/1985 | Thomsen et al. | 404/2 |
| 4,537,921 | 8/1985 | Uffner et al. | 524/59 |
| 4,569,968 | 2/1986 | Uffner et al. | 525/54.5 |
| 4,572,702 | 2/1986 | Bone | 404/65 |
| 4,616,954 | 10/1986 | Taga | 404/74 |
| 4,699,540 | 10/1987 | Gibbon et al. | 404/49 |
| 4,745,155 | 5/1988 | Grossi | 525/54.5 |
| 4,784,516 | 11/1988 | Cox | 404/69 |
| 4,824,283 | 4/1989 | Belangie | 404/64 |
| 4,861,043 | 8/1989 | Anderson et al. | 277/1 |
| 4,871,809 | 10/1989 | Szarka | 525/131 |
| 4,927,291 | 5/1990 | Belangie | 404/64 |
| 4,936,704 | 6/1990 | Killmeyer | 404/74 |
| 4,956,500 | 9/1990 | Vermillion | 525/54.5 |
| 4,963,056 | 10/1990 | Cihal | 404/69 |
| 4,968,178 | 11/1990 | Koster et al. | 404/49 |
| 5,190,395 | 3/1993 | Cathey et al. | 404/74 |
| 5,338,130 | 8/1994 | Baerveldt | 404/33 |
| 5,352,064 | 10/1994 | Carruthers et al. | 405/229 |
| 5,405,212 | 4/1995 | Swisher, Jr. et al. | 404/74 |
| 5,473,848 | 12/1995 | Kangas | 52/396 |
| 5,489,164 | 2/1996 | Tusch et al. | 405/152 |
| 5,494,373 | 2/1996 | Amon | 404/74 |
| 5,513,927 | 5/1996 | Baker et al. | 404/47 |
| 5,616,782 | 4/1997 | Thompson et al. | 560/149 |
| 5,649,784 | 7/1997 | Ricaud et al. | 404/47 |
| 5,660,501 | 8/1997 | Herwegh | 405/152 |
| 5,664,906 | 9/1997 | Baker et al. | 404/67 |

*Primary Examiner*—Eileen Dunn Lillis
*Assistant Examiner*—Gary S. Hartmann
*Attorney, Agent, or Firm*—Head, Johnson & Kachigian

[57] ABSTRACT

A method to produce an expansion joint for adjacent roadway slabs having an expansion gap therebetween. A recess is cut or formed into the surface of each adjacent roadway slab to create a pair of recesses parallel to and adjacent the expansion gap. The recesses are cleaned to a sound, dust-free and rust-free surface. A temporary form is inserted in the expansion gap between the adjacent roadway slabs. A mortar mixture of a slightly resilient polymer and aggregate is installed in each recess to form a pair of parallel nosings adjacent the expansion gap. High-strength filler blocks are encapsulated within the mortar mixture to reduce the volume of the mortar mixture and to thereby reduce the cost of the nosings. A temporary backing is inserted in the expansion gap between the nosings. An initially liquid sealant is installed between the nosings and on top of the temporary backing which will cure to form a flexible seal.

16 Claims, 4 Drawing Sheets

EXPANSION JOINT SYSTEM

BACKGROUND OF THE INVENTION

1. Field of the Invention

The present invention is directed to an expansion joint system for bridges, roadways, parking structures and the like wherein adjacent roadway slabs are subject to movement yet a flexible seal is required in the expansion gap between adjacent roadway slabs. In particular, the present invention is directed to an expansion joint system which decreases the cost of like joints while providing a high strength, impact resistant, semi-flexible joint nose and allow various liquid or preformed seals to be used in the gap to absorb the movement.

2. Prior Art

Roadways, bridges and parking structures are customarily built of sections or slabs arranged with an expansion gap between adjacent slabs. It is known that the slabs will expand and contract in response to temperature changes. In many applications, such as bridges and parking structures, loading due to vehicular traffic also causes vertical movement of the slabs.

Notwithstanding the movement of the slabs, a flexible joint which will retain a watertight seal is highly desirable. A watertight seal will prevent water from getting beneath the slabs and rusting bridges or parking structure components. In freezing conditions, the water will cause damage because of heaving. Additionally, road salts are highly corrosive to bridge elements. A seal in the expansion joint will also prevent debris from lodging in the joint and causing problems.

Many materials in various arrangements have heretofore been used to seal roadway, bridge and parking structure expansion joints. Some of the materials lose their adhesion and quickly require replacement. As an example, in applications with an asphalt overlay, the seal might hold but the asphalt may crumble away.

In new roadway, bridge and parking structure construction, time may not be a critical factor in installation of the joint seal. In remedial applications, however, time is a critical factor so that downtime must be minimized, particularly where vehicular traffic has to be returned as soon as possible.

Various expansion joints have heretofore been proposed. As an example, Gibbon (U.S. Pat. No. 4,699,540) discloses an expansion joint system where a preformed longitudinal resilient tube of heat cured silicone is installed in the recess. An initially flowable adhesive silicone is then injected into the recess on both sides of the tube.

Galbreath (U.S. Pat. No. 4,447,172) discloses a flexible elastomeric membrane wherein adhesive may be utilized to assist in holding the membrane to the side rails.

Cihal (U.S. Pat. No. 4,963,056) provides layers of plastic concrete compound which are cast in the recess. An adhesive coating of an epoxy resin is coated on top of the second layer to assist in retaining a pad which spans the expansion gap.

Belangie (U.S. Pat. Nos. 4,824,283 and 4,927,291) provides a preformed strip of silicone which floats or is embedded in a silicone adhesive.

Peterson et al. (U.S. Pat. No. 4,279,533) disclose an expansion joint system wherein a metal plate secured to one concrete section bridges an expansion slot. The remainder of the recess is filled with a premolded elastomeric slab surrounded by edge portions which are molded on the job site.

Watson (U.S. Pat. No. 4,080,086) discloses a joint sealing apparatus having a pair of elongated elastomeric pads embedded with crushed rock which are secured to the concrete slabs by studs and nuts. A flexible, resilient elongated member extends between the pads.

Semi-flexible polymer concretes have been used to form or repair joints in bridges and parking decks for many years. A non-cementious binder which has various degrees of flexibility is combined with aggregates.

Cathey et al. (U.S. Pat. No. 5,190,395) discloses an expansion joint apparatus wherein a recess is filled with a polymer-based concrete mortar compound. A silicone sealant is installed between the nosings to form a flexible seal. In some cases, an unusually large volume of polymer-based mortar mixture is needed. Polymer-based mortar mixture is more expensive than ordinary concrete. Thus, when an application requires large volumes of polymer-based concrete, the cost of the application is very expensive.

It is a principal object and purpose of the present invention to provide an expansion joint system for both new construction and remedial applications which may be installed quickly yet is extremely durable.

It is a further object and purpose of the present invention to reduce the cost of the expansion joint system by replacing some of the polymer-based mortar mixture required to form nosings with less expensive high-strength filler blocks.

SUMMARY OF THE INVENTION

An expansion joint system is provided in the present invention to be used for roadways, bridges, parking structures and like. Adjacent slabs are provided with an expansion gap therebetween for thermal expansion and dynamic loading. A recess is provided or is cut into each adjacent slab. The base of each recess is parallel to the surface of the slab. The sidewall of each recess is parallel to the expansion gap between adjacent slabs. The walls and bases of the recesses are cleaned by sandblasting or other methods to remove all rust, corrosion and foreign materials.

A temporary form is inserted in the expansion gap having a top flush with the surfaces of the adjacent slabs. A leveling layer of mortar mixture, consisting of a slightly resilient polymer and an aggregate, is installed in the base of each recess. Filler blocks are then placed on top of the leveling layer. The mortar mixture of slightly resilient polymer and an aggregate is then poured into the recesses with enough mortar mixture to fill the recesses to the surfaces of the adjacent slabs. The mortar mixture cures to form solid nosings.

The temporary form is removed and the opposed faces of the nosings are cleaned. In one preferred embodiment, a preformed backer rod is inserted and wedged in the expansion gap between the nosings to form a shelf. A sealant, initially in liquid form, is then poured or inserted in the expansion gap on top of the backer rod in order to form a watertight seal.

In another preferred method, preformed seals, such as extruded neoprene, precompressed foam or EVA foam, may be installed in the expansion gap.

DETAILED DESCRIPTION OF THE PREFERRED EMBODIMENT

Figure 1:
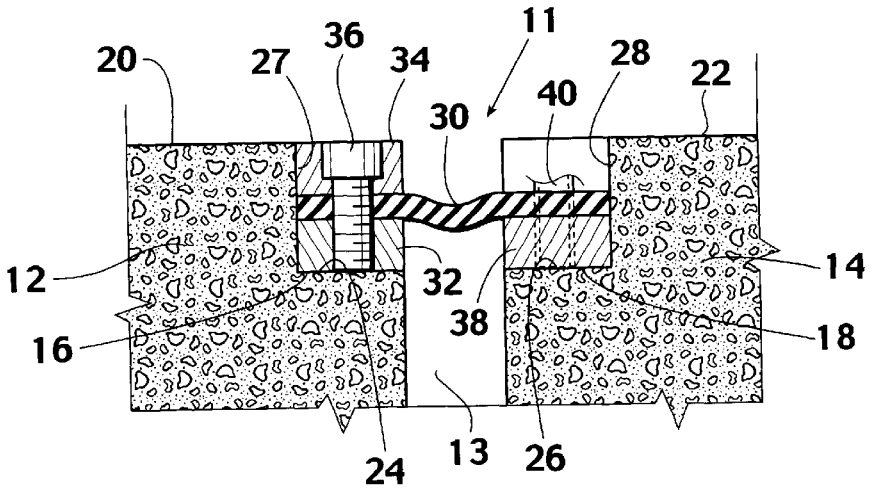
FIG. 1 illustrates a sectional view of adjacent slabs prior to the introduction of the present invention.

Referring to the drawings in detail, FIGS. 1 through 5 illustrate the installation sequence of an expansion joint system 10 of the present invention in a remedial application. The expansion joint system 10 is shown in repair of a failed or damaged strip seal joint 11 on a roadway.

It will be understood that the use of the expansion joint system of the present invention may be used for roadways, bridges, parking structures and the like. In each instance, adjacent slabs are provided with an expansion gap therebetween. A discussion of the use of the expansion joint system in one application will, therefore, be applicable to other uses.

As seen in FIG. 1, a pair of adjacent concrete roadway slabs 12 and 14 is shown in sectional view prior to introduction of the present invention. An expansion gap 13 is provided between the adjacent roadway slabs 12 and 14 to allow for thermal expansion and dynamic movement. Recesses 16 and 18, respectively, are provided in adjacent roadway slabs 12 and 14. The bases 24 and 26 of the recesses 16 and 18, respectively, are parallel to the surfaces 20 and 22 of adjacent roadway slabs 12 and 14, respectively. Sidewalls 27 and 28 of the recesses 16 and 18, respectively, are parallel to the expansion gap 13. An elastomeric strip 30 extends across and seals the expansion gap 13. The elastomeric strip 30 is held in place in recess 16 by a lower steel plate 32 and an upper steel plate 34. The upper steel plate 34 is held in place by a bolt 36.

The elastomeric strip 30 is secured to roadway slab 14 by a lower steel plate 38, an upper steel plate, which has broken off and is not shown, and a bolt 40, a part of which is broken off.

In the condition illustrated in FIG. 1, the elastomeric strip 30 will eventually fall off and the expansion gap 13 will no longer be sealed. An additional problem encountered with the strip seal joint 11 is that it is recessed significantly from the surfaces 20 and 22 of the adjacent roadway slabs 12 and 14, respectively, resulting in a rough ride and an increase in stress on the strip seal joint 11.

Figure 2:
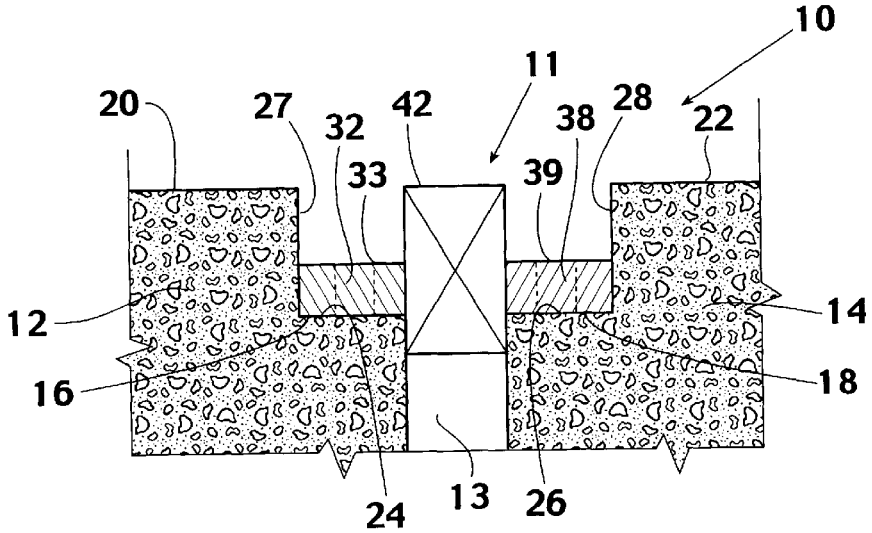
FIGS. 2 through 5 illustrate sectional views showing the installation sequence of an expansion joint system of the present invention in a remedial application replacing a strip seal joint retained by parallel plates.

FIG. 2 illustrates the initial installation steps of the expansion joint system 10 of the present invention. The remaining top plate 34 is removed as well as the elastomeric strip 30 itself. If the lower plates 32 and 38 are sound and secure, they may be left in place. For the remainder of the description of this embodiment, it is assumed that the lower plates 32 and 38 are left in place.

The sidewalls 27 and 28 and the upper surfaces 33 and 39 of the lower steel plates 32 and 38, respectively, must be clean, dry, rust-proof and sound. The top surfaces 33 and 39 of the lower metal plates 32 and 38 are cleaned or sandblasted to a white metal to remove all rust and corrosion. Those parts of the sidewalls 27 and 28 which are located above the lower metal plates 32 and 38 are likewise cleaned or sandblasted.

A temporary form 42 is installed in the expansion gap 13 flush with the surfaces 20 and 22 of the adjacent roadway slabs 12 and 14. Styrofoam or other material is used for this purpose. The temporary form 42 may also be covered with a layer of tape bond-breaker to facilitate removal of the form.

Figure 3:
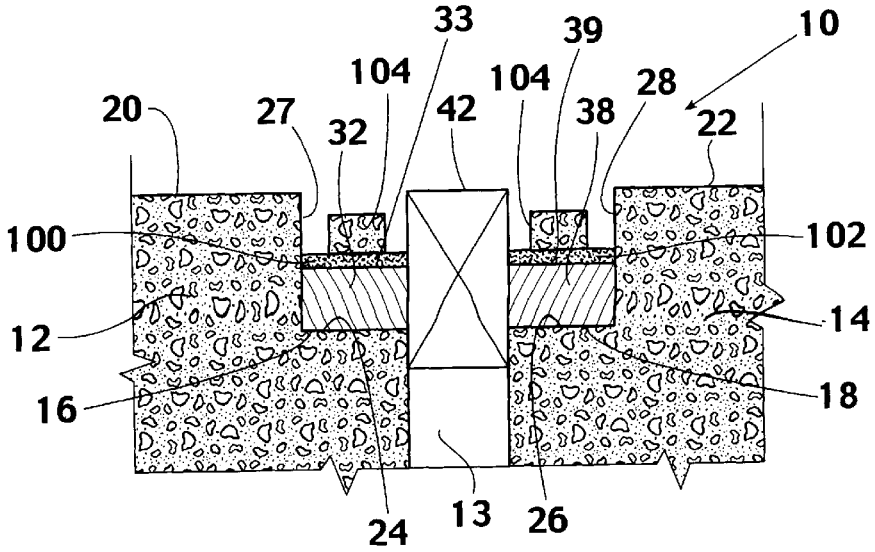

A quantity of slightly resilient polymer is combined with an aggregate, such as crushed stone or flint, to form a mortar mixture. The resilient polymer for the mortar mixture is selected from non-cementious materials such as epoxy, polyurethane, methyl-methacrylates, polysulfides, other polymers or blends of these products. As seen in FIG. 3, the mortar mixture is spread over the bases 33 and 39 of the recesses 16 and 18, respectively, to form leveling layers 100 and 102. High strength filler blocks 104 are placed far enough apart and away from adjacent vertical surfaces to allow the liquid mortar mixture to flow and totally encapsulate the blocks. In one example, the leveling layers are at least one-half inch in thickness, or one-half inch from the highest protrusion in the bases 24 and 26 of recesses 16 and 18, respectively. High-strength filler blocks 104 are placed on the top of each leveling layer 100 and 102. The filler blocks are placed at least one-half inch away from sidewalls 27 and 28 and at least one-half inch away from the expansion gap 13. In the embodiment shown in FIGS. 3 through 5, the filler blocks 104 are concrete, although other materials may be utilized.

Figure 4:
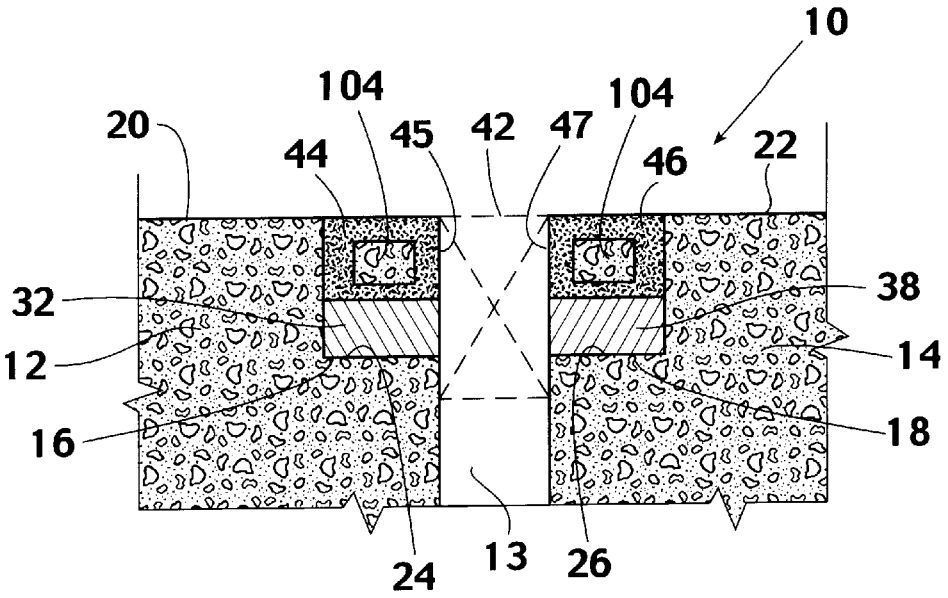

As best seen in FIG. 4, the mortar mixture is then poured into the recesses 16 and 18 with enough mortar mixture to encapsulate the filler blocks 104 and to fill the recesses up to the surfaces 20 and 22 of adjacent roadway slabs 12 and 14, respectively. The filler blocks 104 are surrounded by mortar mixture which is at least one-half inch in thickness. The size of the filler blocks 104 must be chosen to allow for total encapsulation of the filler blocks by the mortar mixture.

The mortar mixture cures to form slightly resilient solid nosings 44 and 46. Once the solid nosings 44 and 46 have cured, the temporary form 42 is removed as seen in FIG. 4.

In one preferred procedure, an initially liquid sealant will be installed in the expansion joint between the nosings.

Figure 5:
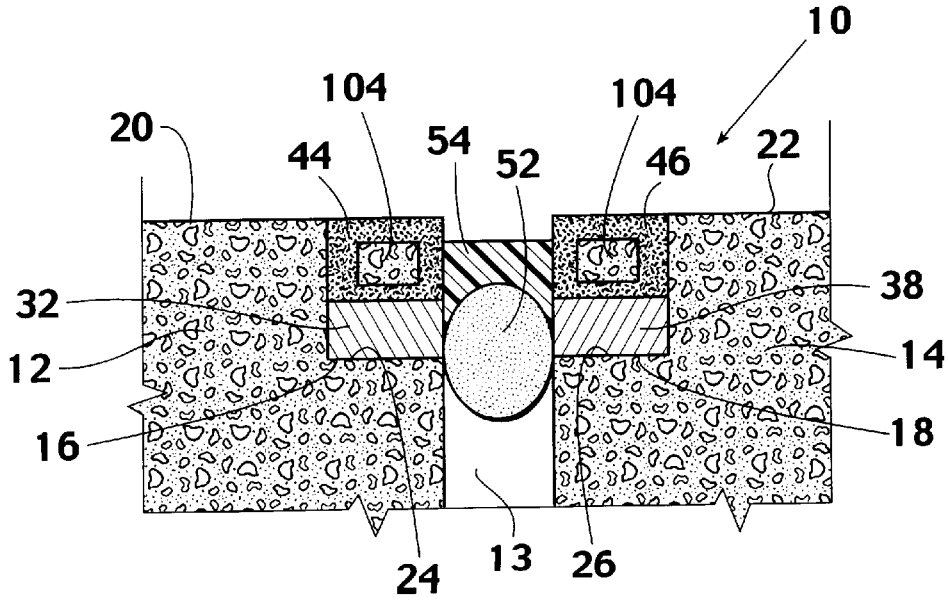

After removal of the temporary form 42, opposed faces 45 and 47 of the nosings 44 and 46, respectively, are cleaned, such as by sandblasting. The opposed faces 45 and 47 may be primed for bonding with a sealant or they may be left unprimed. A preformed backer rod 52 is then inserted and wedged in the expansion gap 13 between the nosings 44 and 46. The backer rod 52 may be cylindrical and composed of a closed cell polyethylene rubber or other similar materials. The backer rod 52 is used solely as a shelf to receive a sealant 54 and is thereafter unimportant in the expansion joint system 10. The sealant 54 which is initially in liquid form is poured or inserted in the expansion gap 13 on top of the backer rod 52, as best seen in FIG. 5.

A one-part silicone sealant such as DOW CORNING 795™ or a two-part rapid-cure self-leveling silicone sealant such as DOW CORNING 902 RCS™ has proved acceptable as the sealant 54. A two-part silicone sealant may be preferred in remedial applications because it cures quicker resulting in less down time.

The liquid sealant may be selected from a group of sealants consisting of silicone sealants, urethanes, polysulfides or blends of these. Liquid sealants may be one part or multi-part systems and can be applied with or without a primer.

Figure 11:
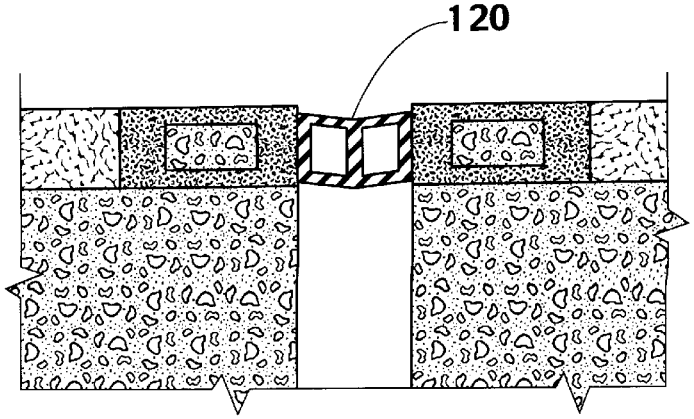
FIG. 11 is a sectional view showing use of a preformed seal as a part of the expansion joint system of the present invention.

FIG. 11 shows an alternate preferred procedure using a preformed seal in the expansion gap. Preformed seals may be constructed of extruded neoprene, precompressed foam or EVA foam.

FIGS. 6 through 10 illustrate the use of the expansion joint system 10 of the present invention for adjacent roadway slabs 12' and 14', which have been overlaid with an asphalt overlay 60 and 62.

Figure 6:
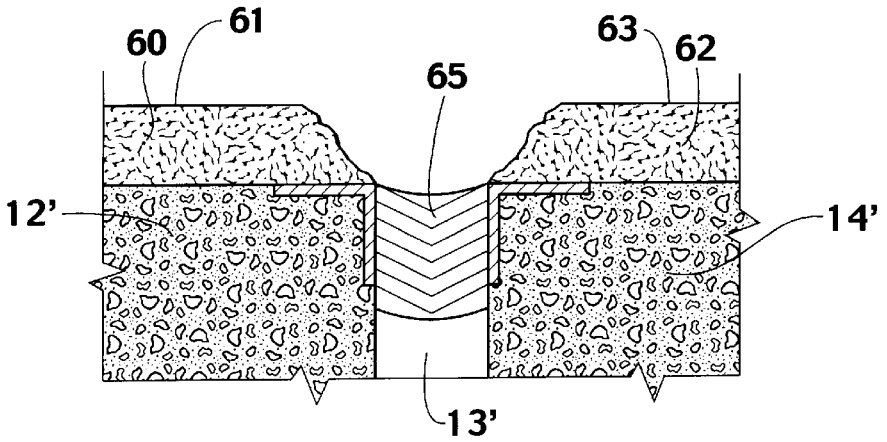
FIG. 6 illustrates a sectional view of adjacent slabs wherein an asphalt overlay is crumbling away due to traffic, weather condition or movement.

FIG. 6 illustrates a sectional view of the adjacent roadway slabs 12' and 14', wherein the asphalt overlay 60 and 62 is crumbling away due to traffic, weather conditions or movement.

Figure 7:
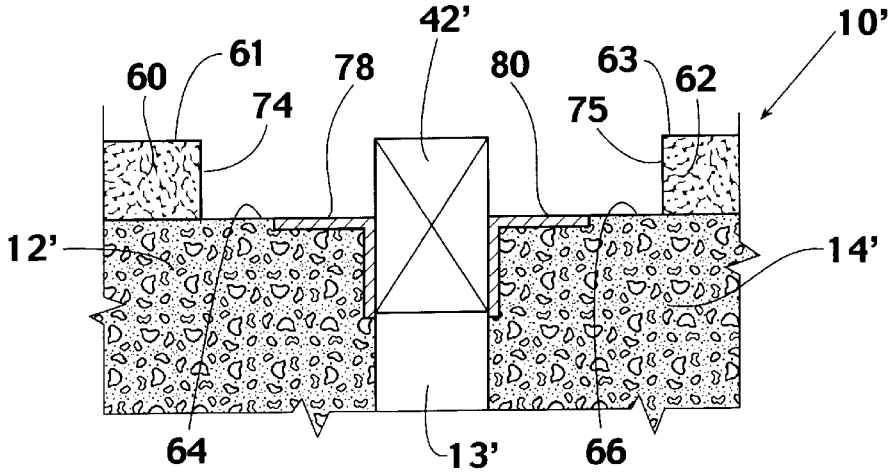
FIGS. 7 through 10 illustrate sectional views showing the installation sequence of an expansion joint system of the present invention in a remedial application having concrete slabs with an asphalt overlay.

As shown in FIG. 7, the existing joint seal 65 will be removed to start installation of the expansion joint system 10' of the present invention. The asphalt overlay 60 and 62 is saw cut parallel with expansion gap 13' to a predetermined width back from the expansion gap 13' to form recesses 64 and 66. The saw cut will be deep enough to reach each adjacent roadway slab 12' and 14' beneath each asphalt overlay 60 and 62, respectively. The sidewall surfaces 74 and 75 and the bases 78 and 80 of the recesses 64 and 66, respectively, must be clean and sound.

As seen in FIG. 7, a temporary form 42' is inserted in the expansion gap 13' between the concrete slabs 12' and 14' flush with the roadway surfaces 61 and 63.

A quantity of slightly resilient polymer is combined with an aggregate, such as crushed stone or flint, to form a mortar mixture. The resilient polymer for the mortar mixture is selected from non-cementious materials such as epoxy, polyurethane, methyl-methacrylates, polysulfides, other polymers or blends of these products.

Figure 8:
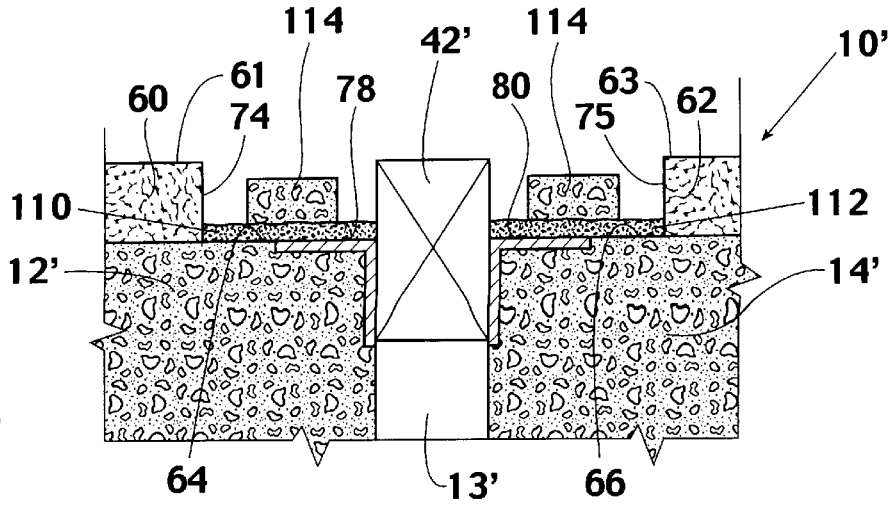
Figure 9:
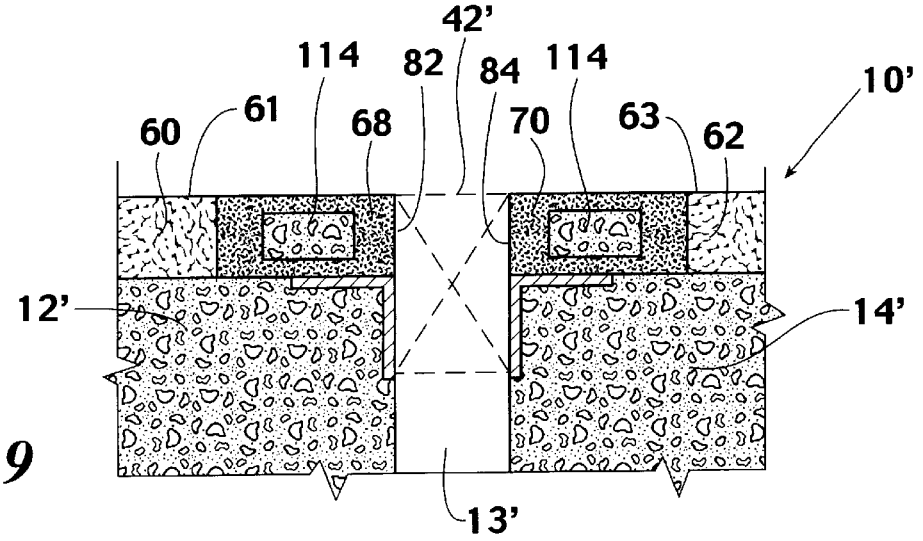

Referring to FIG. 8, the mortar mixture is spread on the bases 78 and 80 of the recesses 64 and 66, respectively, to form leveling layers 110 and 112. Filler blocks 114 are placed on top of the leveling layer spaced from sidewalls 74 and 75 and spaced from the expansion gap 13'. In one example, the leveling layer should be at least one-half inch in thickness, or at least one-half inch higher than the highest protrusion into the bases 24 and 26 of recesses 16 and 18, respectively. A sufficient quantity of the mortar mixture is poured to totally encapsulate and surround the filler blocks and to form nosings 68 and 70, as best seen in FIG. 9. In the embodiment shown in FIGS. 8 through 10, the filler blocks are concrete, although other materials are possible.

After curing of the nosings 68 and 70, the temporary form 42' (shown by dashed lines in FIG. 9), is removed. The opposed faces 82 and 84 of the nosings 68 and 70, respectively, are then cleaned, such as by sandblasting. The opposed faces 82 and 84 may be primed for bonding with a sealant or they may be left unprimed.

Figure 10:
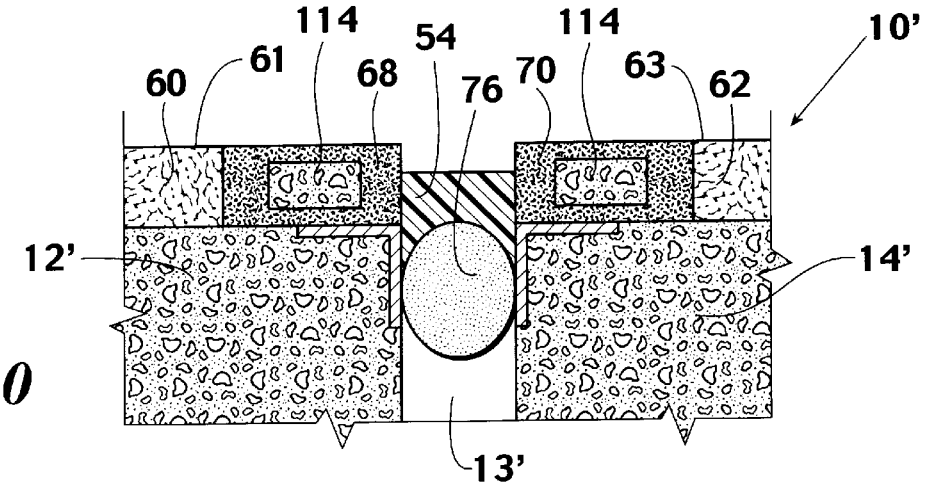

As shown in FIG. 10, a preformed backer rod 76 is wedged in the expansion gap 13' between the nosings. A sealant 54' is poured in the expansion gap 13' on top of the backer rod 76.

The sealant is selected from a group of sealants consisting of silicones, urethanes, neoprenes, polysulfides and blends of these.

Finally, FIG. 11 shows an alternate embodiment of the present invention with an alternate flexible seal installed in the gap between the nosings such as a compression seal 120. In FIG. 11, the nosings are constructed and installed in the manner previously described. The preformed flexible seal may be constructed of neoprene, precompressed foam, or EVA foam is slid and wedged in the expansion gap.

Whereas, the present invention has been described in relation to the drawings attached hereto, it should be understood that other and further modifications, apart from those shown or suggested herein, may be made within the spirit and scope of this invention.

What is claimed is:

1. A method to produce an expansion joint for adjacent roadway slabs having an expansion gap therebetween, which method comprises:

a. cutting or forming a recess into the surface of each said adjacent roadway slab to form a pair of recesses adjacent said expansion gap;

b. cleaning the surfaces of said recesses;

c. installing a form spanning said expansion gap;

d. installing a leveling layer of a semi-self leveling mortar mixture of slightly resilient chemically curing polymer and aggregate into each recess;

e. placing high-strength filler blocks on top of said leveling layer;

f. installing said semi-self leveling mortar mixture of slightly resilient chemically curing polymer and aggregate into each recess to form a pair of nosings parallel to and adjacent said expansion gap;

g. inserting a temporary backing between said nosings in said expansion gap; and h. installing an initially liquid sealant between said nosings to form a flexible seal in said expansion gap between said pair of nosings.

2. A roadway expansion joint as set forth in claim 1 including the additional step of sandblasting opposed surfaces of said nosings prior to inserting said temporary backing and installing an initially liquid sealant.

3. A roadway expansion joint as set forth in claim 1 wherein said polymer in said mortar mixture is selected from a group consisting of:

a. epoxy;

b. polyurethane;

c. methyl-methacrylate;

d. polysulfides;

e. polyester;

f. polyurea; and g. blends of the foregoing.

4. A roadway expansion joint as set forth in claim 1 wherein said filler blocks are high strength blocks.

5. A roadway expansion joint as set forth in claim 1 wherein said aggregate is crushed stone or sand.

6. A method to produce an expansion joint for adjacent roadway slabs as set forth in claim 1 wherein said sealant is a two-part silicone sealant.

7. A method to produce an expansion joint for adjacent roadway slabs as set forth in claim 1 wherein said sealant is selected from a group consisting of silicone, urethane, polysulfide, or a blend of the foregoing.

8. A method to produce an expansion joint for adjacent roadway slabs as set forth in claim 1 including installing a form spanning said expansion gap before installation of said mortar mixture, wherein said form is removed after said mortar has cured.

9. A roadway expansion joint system for adjacent roadway slabs having an expansion gap therebetween, which system comprises:

a. a nosing to fill a recess cut or formed into the surface of each said adjacent roadway slab forming a pair of recesses parallel to and adjacent said expansion gap;

b. a leveling layer of a semi-self leveling mortar mixture of chemically curing polymer and aggregate;

c. filler blocks placed on said leveling layer, said filler blocks encapsulated by said semi-self leveling mortar mixture of chemically curing polymer and aggregate within said nosings; and d. an initially flowable sealant on top of a temporary backing between said nosings in order to form a flexible seal in said expansion gap between said nosings.

10. A roadway expansion joint as set forth in claim 9 wherein said flexible seal is an initially flowable sealant between said nosings and on top of a temporary backing inserted between said nosings in said expansion gap so that said sealant will cure to form a flexible seal.

11. A roadway expansion joint system as set forth in claim 10, wherein said initially flowable sealant is a two-part silicone.

12. A roadway expansion joint system as set forth in claim 9, wherein said polymer in said mortar mixture is selected from a group consisting of:

a. epoxy;

b. polyurethane;

c. methyl-methacrylate;

d. polysulfides;

e. polyester;

f. polyurea; and g. blends of the foregoing.

13. A roadway expansion joint system as set forth in claim 9 wherein the base of each recess is parallel with said roadway surface.

14. A roadway expansion joint system as set forth in claim 9, including a form spanning said expansion gap which is inserted in said expansion gap flush with the surface of said roadway before installation of said mortar mixture wherein said form is removed after said mortar has cured.

15. A roadway expansion joint system as set forth in claim 9, wherein said filler blocks are high strength blocks.

16. A roadway expansion joint system as set forth in claim 9, wherein each said recess has a width and a height, wherein each filler block has a width less than said recess width and wherein each filler block has a height less than said recess height.

* * * * *